United States Patent [19]

Jones et al.

[11] 4,361,097

[45] Nov. 30, 1982

[54] RAILWAY GONDOLA CARS

[75] Inventors: Richard H. Jones, Bethlehem; Gus D. Holabeck; Robert H. Dorian, both of Johnstown, all of Pa.

[73] Assignee: Bethlehem Steel Corporation, Bethlehem, Pa.

[21] Appl. No.: 807,767

[22] Filed: Jun. 17, 1977

[51] Int. Cl.[3] ..... B61D 3/00; B61D 7/00; B61D 17/00

[52] U.S. Cl. ..... 105/406 R; 105/239; 105/244; 105/409

[58] Field of Search ..... 105/239, 247, 282 R, 105/359, 406 R, 409, 244

[56] References Cited

U.S. PATENT DOCUMENTS

| | | | |
|---|---|---|---|
| 45834 | 1/1865 | Keeler | 105/359 |
| 719,868 | 2/1903 | Randel | 105/282 R X |
| 1,054,087 | 2/1913 | Campbell | 105/244 X |
| 1,069,763 | 8/1913 | Campbell | 105/244 X |
| 1,412,660 | 4/1922 | Kuehner | 105/282 R X |
| 1,627,256 | 5/1927 | Smith | 105/282 R X |
| 3,713,400 | 1/1930 | Teoli | 105/406 R |
| 3,964,399 | 6/1976 | Miller et al. | 105/406 R |
| 4,254,714 | 3/1981 | Heap | 105/406 R |

*Primary Examiner*—Robert B. Reeves
*Assistant Examiner*—Howard Beltran
*Attorney, Agent, or Firm*—Joseph J. O'Keefe; John I. Iverson; Michael J. Delaney

[57] ABSTRACT

A railway gondola car suitable for rotary unloading. The floor of the car comprises a pair of concave troughs which extend between the center sill and the sides of the car having their axes parallel to the axis of the center sill along that portion of the car between the trucks. The car has an increased lading capacity and lower center of gravity than conventional gondola cars.

9 Claims, 3 Drawing Figures

RAILWAY GONDOLA CARS

BACKGROUND OF THE INVENTION

This invention relates to a railway car of the gondola type commonly used to carry bulk materials, such as coal, sand, gravel, ore and the like. It relates particularly to a railway gondola car which is loaded through its open top and unloaded in a rotary car dumper by inverting the entire car.

Most gondola cars built in the past have been built in the shape of a rectangular box having a flat bottom and vertical side walls supported by the center sill and side girders respectively. Such gondola cars were somewhat restricted in their carrying capacity and had a high center of gravity. In recent years, railway car builders have attempted to increase the capacity of the gondola car and lower its center of gravity by providing a depressed center. One such car is described in U.S. Pat. No. 3,713,400 to Teoli. While such cars were improvements on conventional gondola cars, they frequently required special materials and components including brake rigging, special jigs and fabrication techniques which added to their manufacturing and maintenance costs.

SUMMARY OF THE INVENTION

It is an object of this invention to provide an improved railway gondola car which has increased lading capacity and a lower center of gravity compared to conventional gondola cars.

It is a further object of this invention to provide an improved gondola car that can distribute end loading through sloping floors and retain conventional brake rigging, yet be easily manufactured and maintained without the need for special jigs or other special manufacturing and maintenance techniques.

It has been discovered that the foregoing objectives can be attained by eliminating the hopper chutes, door frames, hardware, etc., from a conventional high side hopper car and substituting therefor a pair of concave troughs between the center sill and sides of the car.

DESCRIPTION OF THE PREFERRED EMBODIMENT

The preferred embodiment of the gondola car of this invention resembles the conventional A.A.R. "HT" open top self-cleaning hopper car and is designed to utilize many of the components used in the manufacture of such a hopper car although the unique bottom construction of the car of this invention results in car that would be designated by the A.A.R. as a Class "G" gondola car.

Figure 2:
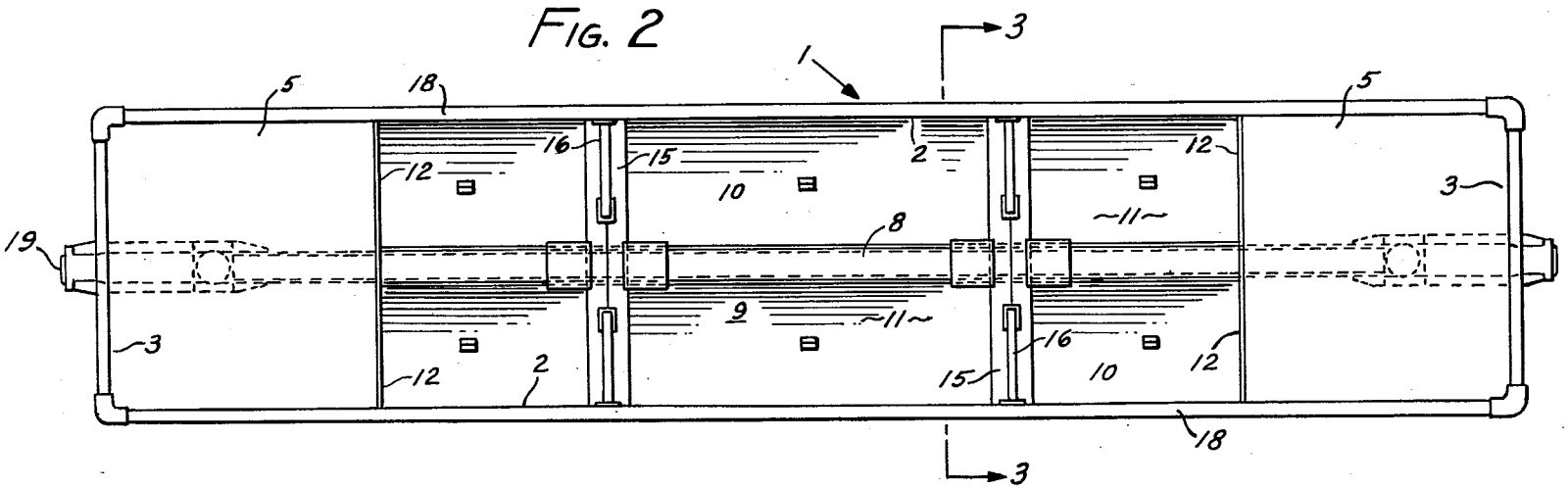
FIG. 2 is a top plan view of the preferred embodiment of the gondola car of this invention.
Figure 1:
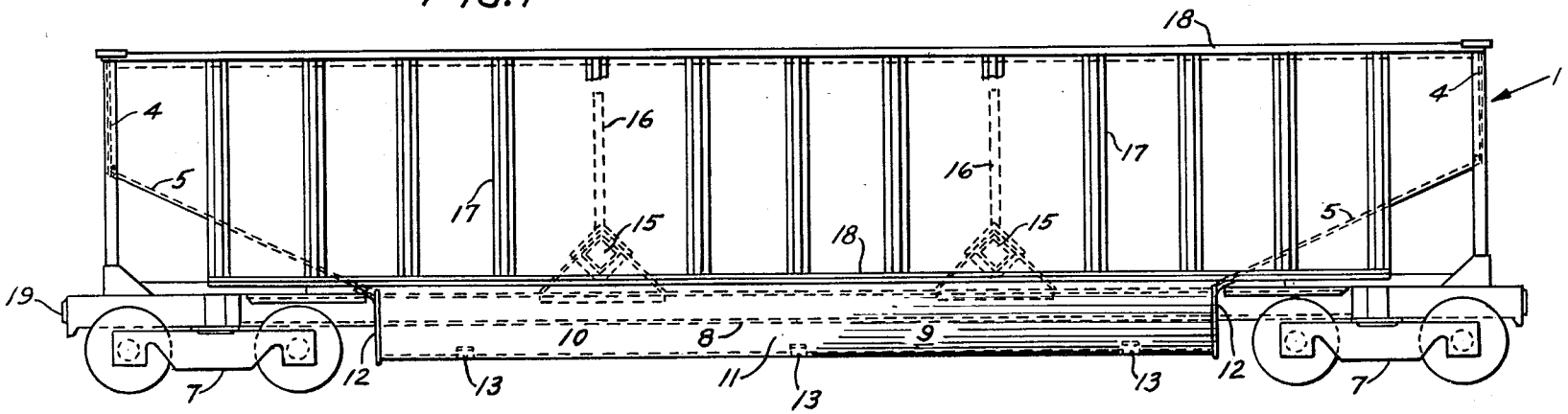
FIG. 1 is a side elevation of the preferred embodiment of the gondola car of this invention.

Referring to FIGS. 1 and 2 the preferred embodiment of this invention comprises a rectangular car 1 having a pair of parallel vertical side walls 2 and a pair of end walls 3. The end walls 3 have an upper vertical portion 4 and an inclined lower portion 5 which extend over conventional car trucks 7 and distribute certain portions of the end loading.

A box girder shaped center sill 8 extends substantially the full length of the car between the trucks 7 and forms the structural support member for the unique floor construction of this car.

Figure 3:
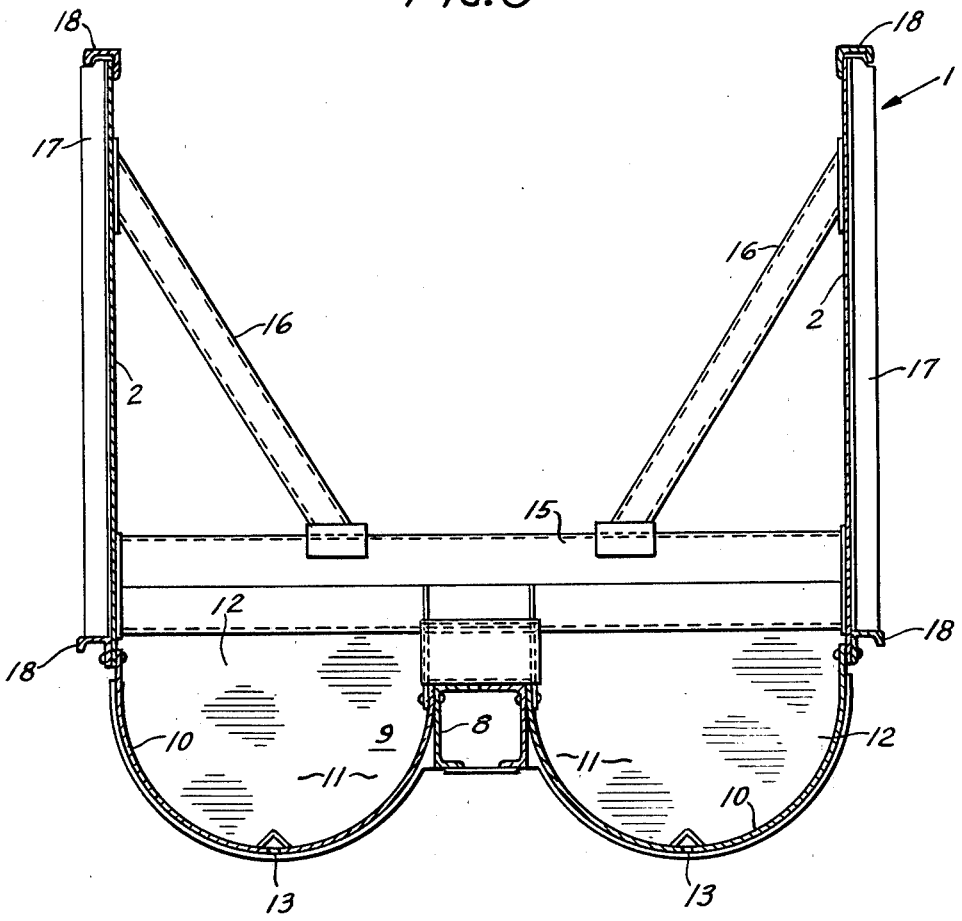
FIG. 3 is a section taken along line 3—3 of FIG. 2.

Floor 9 of the car of this invention is most clearly illustrated in FIG. 3 and comprises the center sill 8 and a pair of concave floor panels 10 positioned one on each side of center sill 8. The longitudinal edge of each of the concave floor panels 10 is secured to one side of the center sill 8 by riveting or welding. The other longitudinal edge of each of the concave floor panels 10 is secured to the bottom of the side walls 2, also with rivets or welding.

As shown in FIG. 3, the concave floor panels 10 are preferably in the form of circular segments, the radius of which is slightly less than one quarter the width of the car. The concave floor panels 10 form a pair of longitudinal troughs 11 of considerable volume alongside and essentially below the center sill 8 for the entire length of the car between the trucks 7, and the inclined end wall portions 5. The troughs 11 are closed at their ends by semicircular vertical cover plates 12 welded or otherwise secured to the ends of the concave floor panels 10. Drainage holes 13 are provided in the bottom of the troughs 11 to prevent the accumulation of moisture. As shown in FIG. 1 the bottom of the troughs 11 extend below the plane which includes the axles of trucks 7, resulting not only in increased lading capacity but also a very low center of gravity.

Tubular transverse cross members 15 and tubular inclined brace members 16 are positioned at spaced intervals along the length of the car and between the opposite side walls 2 and prevent lateral movement of the side walls 2 during the handling of the car. The tubular shape of members 15 and 16 present high strength but minimal resistance to the flow of the bulk material during loading and unloading operations. In addition, side walls 2 are stiffened by spaced vertical stiffeners 17 and longitudinal top and bottom members 18.

The rest of the car components and accessories such as rotary couplers 19, ladders and trucks 7 are items which are conventional and well known in the art of manufacturing railway cars.

It can be seen that the car of this invention provides an improved open top dump gondola car of greatly increased carrying capacity over conventional gondola cars. Likewise the unique floor construction of the car of this invention produces a gondola car with a much lower center of gravity than conventional cars with resulting improvements in handling and performance in operation.

Since, except for the unique floor structure, the car of this invention closely resembles conventional hopper cars, the manufacture and repair of cars of this invention can be easily accomplished in shops usually manufacturing and repairing railway cars without difficulty or added expense.

While we have shown our invention by illustrating and describing the preferred embodiment of it, we have done so by way of example and are not to be limited as there are modifications and adaptations that could be made within the teachings of this invention as claimed.

We claim:

1. A railway car for carrying bulk materials having a pair of side walls and a pair of end walls supported by spaced trucks, the improvement comprising a floor structure having (a) a center sill extending longitudinally over said trucks, (b) a pair of concave floor panels between said trucks, each panel forming a longitudinal curvilinear trough having closed ends, the longitudinal axis of each of said troughs extending parallel to the longitudinal axis of said center sill.

2. The invention in accordance with claim 1 in which transverse cross members are positioned at spaced intervals along the length of the car between the side walls and above the center sill.

3. The invention in accordance with claim 2 in which inclined braces are positioned between the side walls and the transverse cross members.

4. The invention in accordance with claim 1 in which the concave floor panels are in the shape of circular segments.

5. The invention in accordance with claim 1 in which the bottom of the concave floor panels lie below a plane which includes the axles of the spaced supporting trucks.

6. A floor for a railway car comprising a center sill and a pair of longitudinal curvilinear troughs having closed ends secured to opposite sides of said center sill with the longitudinal axes of said troughs extending parallel to the longitudinal axis of said center sill.

7. The floor structure of claim 6 in which the curvilinear troughs are in the shape of circular segments.

8. The floor structure of claim 7 in which the radius of the circular segments is less than $\frac{1}{4}$ the total width of the floor.

9. The floor structure of claim 6 in which the ends of curvilinear troughs are capped with vertical plates.

* * * * *